US009510650B2

(12) United States Patent
Uozumi et al.

(10) Patent No.: US 9,510,650 B2
(45) Date of Patent: Dec. 6, 2016

(54) KNITTED FASTENER STRINGER

(75) Inventors: Norio Uozumi, Toyama (JP); Hidenobu Kato, Toyama (JP); Yoshito Ikeguchi, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/125,124

(22) PCT Filed: Jul. 19, 2011

(86) PCT No.: PCT/JP2011/066346

§ 371 (c)(1),
(2), (4) Date: Dec. 10, 2013

(87) PCT Pub. No.: WO2013/011559

PCT Pub. Date: Jan. 24, 2013

(65) Prior Publication Data

US 2014/0123444 A1 May 8, 2014

(51) Int. Cl.

| | |
|---|---|
| ***A44B 19/56*** | (2006.01) |
| ***A44B 19/34*** | (2006.01) |
| ***D04B 21/20*** | (2006.01) |

(52) U.S. Cl.

CPC ..... *A44B 19/56* (2013.01); *A44B 19/343* (2013.01); *D04B 21/20* (2013.01); *D10B 2501/0631* (2013.01); *Y10T 24/2511* (2015.01)

(58) Field of Classification Search

CPC ..... A44B 19/343; A44B 19/56; D04B 21/20; D04B 2501/0631; Y10T 24/2511

USPC ..... 24/392, 393

See application file for complete search history.

(56) References Cited

U.S. PATENT DOCUMENTS

| | | | | |
|---|---|---|---|---|
| 5,502,986 | A * | 4/1996 | Matsuda et al. | 66/193 |
| 5,540,064 | A | 7/1996 | Matsuda et al. | |
| 5,802,883 | A * | 9/1998 | Matsuda et al. | 66/193 |

FOREIGN PATENT DOCUMENTS

| | | | |
|---|---|---|---|
| EP | 399708 | A1 | 11/1990 |
| EP | 0743025 | A2 | 11/1996 |
| JP | 49-31447 | A | 3/1974 |
| JP | 2-297301 | A | 12/1990 |
| JP | 8-228813 | A | 9/1996 |
| JP | 2005-230040 | A | 9/2005 |
| WO | 2009/128140 | A1 | 10/2009 |
| WO | 2011-007411 | A1 | 1/2011 |

OTHER PUBLICATIONS

International Search Report, PCT Application No. PCT/JP2011/066346, mailed Oct. 11, 2011.

(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

In a knitted fastener stringer, a fastener element is fixed by a fixing chain stitch yarn disposed on an element attaching portion of a fastener tape. This fixing chain stitch yarn has a first needle loop which is knitted into a ground structure and a second needle loop which fixes upper and lower leg portions of the fastner element. As a result, it is possible to achieve an improvement of productivity and a large reduction of a manufacturing cost by increasing a knitting speed and further to stably obtain flexibility and a soft texture in the knitted fastener stringer.

4 Claims, 7 Drawing Sheets

(56) References Cited

OTHER PUBLICATIONS

Supplementary European Search Report, European Patent Application No. 11869589.9, mailed Apr. 9, 2015.
Office Action, Japanese Patent Application No. 2013-524542, mailed Feb. 9, 2016.

* cited by examiner

KNITTED FASTENER STRINGER

This application is a national stage application of PCT/JP2011/066346, which is incorporated herein by reference.

TECHNICAL FIELD

The present invention relates to a knitted fastener stringer in which a continuous fastener element is knitted into and attached to an element attaching portion knitted in a double structure at the same time as knitting a fastener tape comprising a tape main body portion and the element attaching portion by using a double warp knitting machine having two rows of needle beds.

BACKGROUND ART

Conventionally, a fastener stringer (knitted fastener stringer) for a knitted slide fastener which is obtained by knitting a continuous fastener element into an element attaching portion along a length direction of a fastener tape at the same time as knitting the fastener tape by using a double warp knitting machine having two rows of needle beds like for example a double raschel knitting machine has been known.

One example of this knitted fastener stringer is disclosed in JP H08-228813 A (Patent Document 1). A knitted fastener stringer described as one of embodiments in this Patent Document 1 is shown in FIGS. 10 and 11. In FIG. 11, a knit structure is illustrated with knitted stitches loosened to make the knit structure in an element attaching portion of a fastener tape easy to understand.

A knitted fastener stringer 50 of this Patent Document 1 comprises a fastener tape 51 having a warp knit structure and a continuous (coil-shaped) fastener element 52 knitted into an element attaching portion 51*a* which is formed in a longitudinal side edge portion of the fastener tape 51.

A ground structure of the fastener tape 51 is configured by a chain stitch yarn 61 (1-0/0-0/0-1/1-1), a tricot stitch yarn 62 (1-2/1-1/1-0/1-1), and an weft inserted yarn 63 (0-0/2-2/4-4/2-2) which is inserted in a zigzag pattern while striding across four wales of the fastener tape 51.

A fixing chain stitch yarn 64 (0-1/1-0/1-0/0-1) having a double knit structure of a back needle row (B) and a front needle row (F) is knitted into two wales disposed on a tape main body portion side out of three wales constituting the element attaching portion 51*a* respectively.

In this fixing chain stitch yarn 64, as shown in FIG. 11, a first needle loop 64*a* (back side needle loop) formed in the back needle row is knitted into the ground structure of the element attaching portion 51*a* so as to be entangled with a needle loop of the above chain stitch yarn 61 and a needle loop of the above tricot stitch yarn 62, and forms the dense ground structure.

Also, a second needle loop 64*b* (front side needle loop) of the fixing chain stitch yarn 64 formed in the front needle row presses and fixes upper and lower leg portions of the fastener element 52 to the ground structure of the element attaching portion 51*a* by striding across the pair of upper and lower leg portions of the fastener element 52 and being entangled with the second needle loop 64*b* to be subsequently formed.

In this particular case, as shown in FIGS. 10 and 11, two first and two second needle loops 64*a*, 64*b* are formed in the fixing chain stitch yarn 64 at each one pitch in a tape length direction of the fastener element 52, and the upper and lower leg portions of the fastener element 52 are disposed while shifted in the length direction to pass through different courses respectively.

Then, a sinker loop of the fixing chain stitch yarn 64 is inserted between the upper and lower leg portions of the fastener element 52, and the upper leg portion and the lower leg portion of the fastener element 52 are pressed and fixed by different second needle loops 64*b* respectively.

In the knitted fastener stringer 50 of Patent Document 1 configured as above, since the first needle loop 64*a* of the fixing chain stitch 64 is knitted into the ground structure of the element attaching portion 51*a*, the element attaching portion 51*a* of the fastener tape 51 can be formed in a dense structure. Furthermore, the upper and lower leg portions of the fastener element 52 are fastened and fixed by the second needle loop 64*b* of the fixing chain stitch yarn 64, and in this particular embodiment, the upper leg portion and the lower leg portion are fixed by the different second needle loops 64*b* respectively. As a result, according to Patent Document 1, the stretch property of the element attaching portion 51*a* of the fastener tape 51 becomes pretty much lost, and the fastener element 52 can be fixed to the element attaching portion 51*a* in a dimensionally stable state.

In Patent Document 1, a knitted fastener stringer 55 shown in FIG. 12 is disclosed as another example. In this knitted fastener stringer 55, the fixing chain stitch yarn 64 of a double structure is knitted into an element attaching portion 56*a* of a fastener tape, and the fixing chain stitch yarn 64 comprises two first and two second needle loops 64*a*, 64*b* at each one pitch of the fastener element 52 to form the element attaching portion 56*a* of the fastener tape in a dense structure.

In this case, a pair of upper and lower leg portions of the fastener element 52 are formed while overlapped in a tape front and rear direction to pass through the same course, and the pair of upper and lower leg portions are fastened and fixed to the element attaching portion 56*a* by the second needle loop 64*b* by being inserted into the alternate second needle loop 64*b* at the same time.

Thus, in the knitted fastener stringer 55 according to this another example, the second needle loop 64*b* fixing the upper and lower leg portions of the fastener element 52 to the fixing chain stitch yarn 64 and the second needle loop 64*b* not fixing the upper and lower leg portions are disposed alternately. Even in this knitted fastener stringer 55, the stretch property of the element attaching portion 56*a* of the fastener tape becomes pretty much lost, and the fastener element 52 can be fixed to the element attaching portion 56*a* in a dimensionally stable state.

PRIOR ART DOCUMENT

Patent Document

Patent Document 1: JP H08-228813 A

SUMMARY OF THE INVENTION

Problem to be Solved by the Invention

In the knitted fastener stringer disclosed in Patent Document 1, as described above, in order to stably fix the fastener element 52 to the element attaching portion of the fastener tape, the fixing chain stitch yarn 64 of the double structure comprises two first and two second needle loops 64*a*, 64*b* at each one pitch of the fastener element 52, and is knitted into the element attaching portion so as to press and fix the upper and lower leg portions of the fastener element 52 by the second needle loop 64*b*.

Meanwhile, in general, since a fastener tape formed of a warp knit structure has an advantage of being excellent in flexibility and texture as compared with for example a fastener tape formed of a woven structure, a knitted slide fastener in which a fastener element is knitted into a fastener tape of the warp knit structure is mostly used for a thin clothes such as an underwear.

However, in a case that the fixing chain stitch yarn 64 of the double structure is knitted into the element attaching portion 51*a* like for example the knitted fastener stringer of Patent Document 1, since the fixing chain stitch yarn 64 is knitted with two first and two second needle loops 64*a*, 64*b* at each one pitch of the fastener element 52 as described above, a knit structure of the element attaching portion becomes dense by the first needle loop 64*a*, and the stretch property of the element attaching portion is impaired.

Also in Patent Document 1, the upper and lower leg portions of the fastener element 52 are fastened and strongly attached by the second needle loop 64*b* of the fixing chain stitch yarn 64, but on the other hand, a movement of the upper and lower leg portions in the fastener element 52 is restricted by the second needle loop 64*b* knitted tightly with a narrow interval, and as a result, the element attaching portion becomes difficult to bend in a front and rear direction and a width direction of the fastener tape. For this reason, in the knitted fastener stringer of Patent Document 1, there was a case that the flexibility and the texture was deteriorated, and features that the knitted fastener stringer should originally have were impaired.

Also, when producing the knitted fastener stringer, in order to reduce a manufacturing cost, it is required to increase production efficiency by increasing a knitting speed of a knitting machine which knits the fastener stringer. However, in case of the knitted fastener stringer of Patent Document 1, since there is a need to form two first and two second needle loops 64*a*, 64*b* of the fixing chain stitch yarn 64 with respect to each one pitch of the fastener element, forming four knitted stitches in total, there is a limit to increasing the knitting speed, and it was difficult to improve the production efficiency and reduce the manufacturing cost.

The invention was made in consideration of the above conventional problem, and its specific object is to provide a knitted fastener stringer whose flexibility and texture characteristic of a knit can be prevented from being impaired even if a fastener element is knitted and fixed to an element attaching portion by using a fixing chain stitch yarn of a double structure, and whose manufacturing cost can be reduced by increasing a knitting speed.

Means for Solving the Problems

To achieve the above object, as a basic configuration, a knitted fastener stringer provided by the invention comprises a fastener tape of a warp knit structure in which an element attaching portion is disposed along one side edge of a tape main body portion, and a continuous fastener element knitted and fixed to the element attaching portion at the same time as knitting the fastener tape, the element attaching portion being configured at least by using a fixing chain stitch yarn which holds and fixes a pair of upper and lower leg portions of the fastener element in a tape front and rear direction, the fixing chain stitch yarn comprising a double structure with a first needle loop knitted into a ground structure on a lower surface side of the pairs of the upper and lower leg portions of the element attaching portion and a second needle loop which is disposed on an upper surface side of the upper and lower leg portions, and fastening and fixing the upper and lower leg portions, being most primarily characterized in that the one first and one second needle loops of the fixing chain stitch yarn are formed at each one pitch of the fastener element, the first needle loops interlace with the corresponding ground knitting yarns and subsequent first needle loops, and each second needle loop fastens and fixes the upper and lower leg portions to the element attaching portion by striding across them while interlacing with subsequent second needle loops in series.

In the knitted fastener stringer according to the invention, it is preferable that a first weft inserted yarn which is inserted astride two or more rows of wales, and a second weft inserted yarn which is inserted in a direction intersecting the first weft inserted yarn between courses while striding across two or more rows of wales are disposed in the ground structure of the tape main body portion and the element attaching portion.

Also, in the knitted fastener stringer of the invention, it is preferable that the tape main body portion comprises an ear portion formed by two or more rows of wales on the other side edge side of the tape main body portion and the second weft inserted yarn is removed from the ear portion.

Further, in the knitted fastener stringer of the invention, it is preferable that a two stitch yarn or a tricot stitch yarn is knitted into the ground structure of the tape main body portion and the two stitch yarn or the tricot stitch yarn is knitted into the ground structure of the element attaching portion.

Effect of the Invention

In a knitted fastener stringer according to the invention, an element attaching portion which is disposed astride at least two wales in one side edge portion of a fastener tape is knitted in a double structure by using a fixing chain stitch yarn having a first needle loop which is knitted into a ground structure of the element attaching portion and a second needle loop which fastens and fixes a pair of upper and lower leg portions of a fastener element.

Particularly in the invention, the one first and one second needle loops are formed in the fixing chain stitch yarn at each one pitch in a tape length direction of the fastener element, the pair of upper and lower leg portions are inserted with each formation of the one second needle loop, and the upper and lower leg portions are firmly fastened and fixed to the element attaching portion by the second needle loop of the fixing chain stitch yarn.

Note that, in the invention, the pitch of the fastener element means a distance in a tape longitudinal direction between center lines of coupling head portions adjacent to each other in the continuous fastener element.

As described above, in the knitted fastener stringer of the invention, since the first and second needle loops of the fixing chain stitch yarn are formed at a rate of one loop per one pitch of the fastener element, the number of stitches formed in the fixing chain stitch yarn per unit length becomes smaller compared with for example the above-mentioned knitted fastener stringer of Patent Document 1. As a result, a knitting speed when knitting the fastener stringer can be largely increased (by simple arithmetic, the knitting speed of the invention can be increased to twice the knitting speed of Patent Document 1). Therefore, production efficiency of the knitted fastener stringer is increased more easily than ever before, and a manufacturing cost can be largely decreased in the invention.

Also in the invention, the distance in the tape length direction between stitches formed in the element attaching portion can be widened more than, for example, the knitted fastener stringer of Patent Document 1 (in other words, a stitch density in a wale direction in the element attaching portion can be decreased, and the ground structure of the element attaching portion is formed more loosely in the tape length direction than Patent Document 1). As a result, a stretch property of the element attaching portion can be inhibited from being impaired by knitting the fixing chain stitch yarn like Patent Document 1.

In addition, since the second needle loop of the invention more easily allows a movement of the upper and lower leg portions in the fastener element than in Patent Document 1 while fastening and fixing the upper and lower leg portions of the fastener element to the element attaching portion, the element attaching portion can be easily bent in a tape front and rear direction and a width direction.

Further, in this case, since the stitch density in the wale direction in the tape main body portion is decreased, the tape main body portion can be more softly formed. Therefore, the knitted fastener stringer of the invention is formed into a soft and high quality knitted fastener stringer having great flexibility and a rich texture.

In this knitted fastener stringer of the invention, a first weft inserted yarn which is inserted astride two or more rows of wales and a second weft inserted yarn which is inserted in a direction intersecting the first weft inserted yarn between courses while striding across two or more rows of wales are disposed in the ground structure of the tape main body portion and the element attaching portion.

Since these first and second weft inserted yarns are disposed, by reinforcing the tape main body portion and the element attaching portion, their ground structure (stitch pattern) can be firmly and strongly formed while the fastener tape properly keeps original flexibility and texture of a knit.

As a result, the fastener element is knitted and fixed to a predetermined position of the element attaching portion with a high degree of accuracy and stability, and also, the fastener element can be prevented from falling (rolling) in a manner that a position of the knitted and fixed fastener element is inclined to a tape surface of the fastener tape. As a result, for example, when forming a slide fastener by using the knitted fastener stringer of the invention, a coupling breakage of element rows can be made difficult to occur by effectively increasing a coupling strength of the right and left element rows.

Furthermore, since the tape form is stable by the tape main body portion being firmly and strongly formed, when sewing the tape main body portion of the fastener tape to a fastener-attached product such as a clothes, the attachment of the fastener tape becomes stable, and a displacement of the fastener tape with respect to the fastener-attached product becomes difficult to occur.

Also, even though these first and second weft inserted yarns are disposed, the stretch property of the fastener tape can be stably maintained, and even when the fastener tape is repeatedly stretched in the length direction, it is possible to stably shrink it to an original length and to shrink the whole tape width in a balanced manner.

In this case, it is preferable that the first and second weft inserted yarns are inserted astride two or three rows of wales to more effectively stabilize the ground structure of the tape main body portion and the element attaching portion.

In the knitted fastener stringer of the invention, the tape main body portion comprises an ear portion configured by two or more rows of wales on the other side edge side of the tape main body portion, and the ear portion is formed while the second weft inserted yarn is removed. Since the ear portion does not have the second weft inserted yarn as above, the ear portion is more softly formed, and the flexibility of the whole fastener tape can be effectively increased.

Furthermore, in the knitted fastener stringer of the invention, the fastener tape is configured by knitting a two stitch yarn or a tricot stitch yarn into the ground structure of the tape main body portion and by knitting the two stitch yarn or the tricot stitch yarn into the ground structure of the element attaching portion.

By using the two stitch yarn and the tricot stitch yarn in the tape main body portion and the element attaching portion as above, since stitches of adjacent wales can be securely connected to each other, and a position of the stitch can be prevented from being displaced in a warp direction and a weft direction in each wale, the knit structure of the tape main body portion and the element attaching portion can be firmly and stably formed. As a result, a fixation of the fastener element to the element attaching portion and an attachment of the fastener tape sewn to the fastener-attached product are further stabilized.

Note that in this case, although one knit structure can be chosen from four kinds of knit structures of a knit structure in which the two stitch yarn is knitted into the tape main body portion and the element attaching portion, a knit structure in which the two stitch yarn is knitted into the tape main body portion and the tricot stitch yarn is knitted into the element attaching portion, a knit structure in which the tricot stitch yarn is knitted into the tape main body portion and the two stitch yarn is knitted into the element attaching portion, and a knit structure in which the tricot stitch yarn is knitted into the tape main body portion and the element attaching portion, among them, by adopting the knit structure in which the two stitch yarn is knitted into the tape main body portion and the element attaching portion, the displacement of the stitch can be prevented from occurring, and the knit structure with the dimensional stability increased can be formed.

MODE(S) FOR CARRYING OUT THE INVENTION

Hereinafter, preferable embodiments of the invention will be explained in detail with examples and with reference to drawings. Note that the invention is not limited to the embodiments which will be described later, but can be variously modified as long as the structure has substantially the same structure as the invention and achieves the same operation and effect.

For example, a continuous fastener element of a fastener stringer which will be explained in the following embodiment is formed by molding a monofilament into a coil shape, however, the invention is not limited to this, but maybe formed by molding the monofilament into a zigzag shape. Also, a material and fineness of a yarn constituting a fastener tape, thickness of the fastener tape, and the like can be arbitrarily modified as needed.

Embodiment 1

Figure 1:
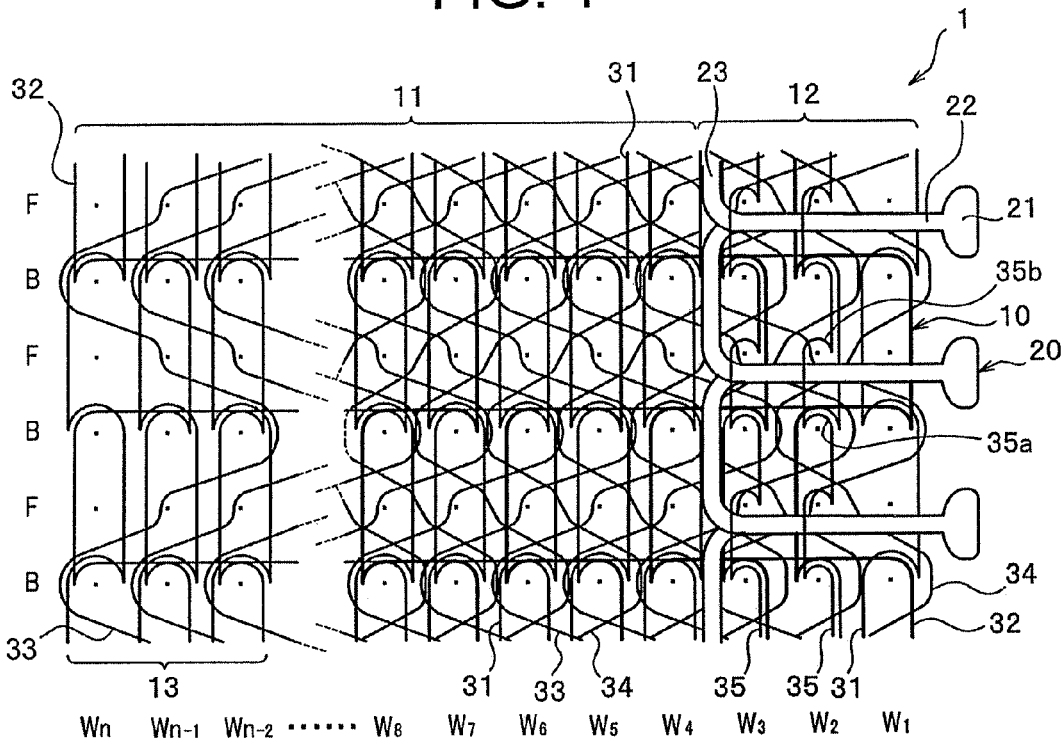
FIG. 1 is a structure diagram illustrating a knit structure of a fastener tape in a knitted fastener stringer according to embodiment 1 of the invention.
Figure 2:
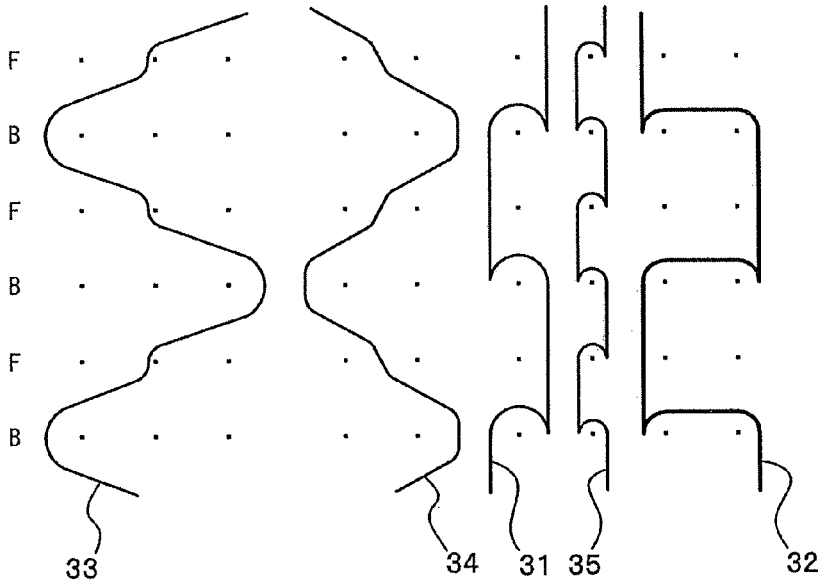
FIG. 2 is a structure diagram of each constituent yarn used for the fastener tape.
Figure 3:
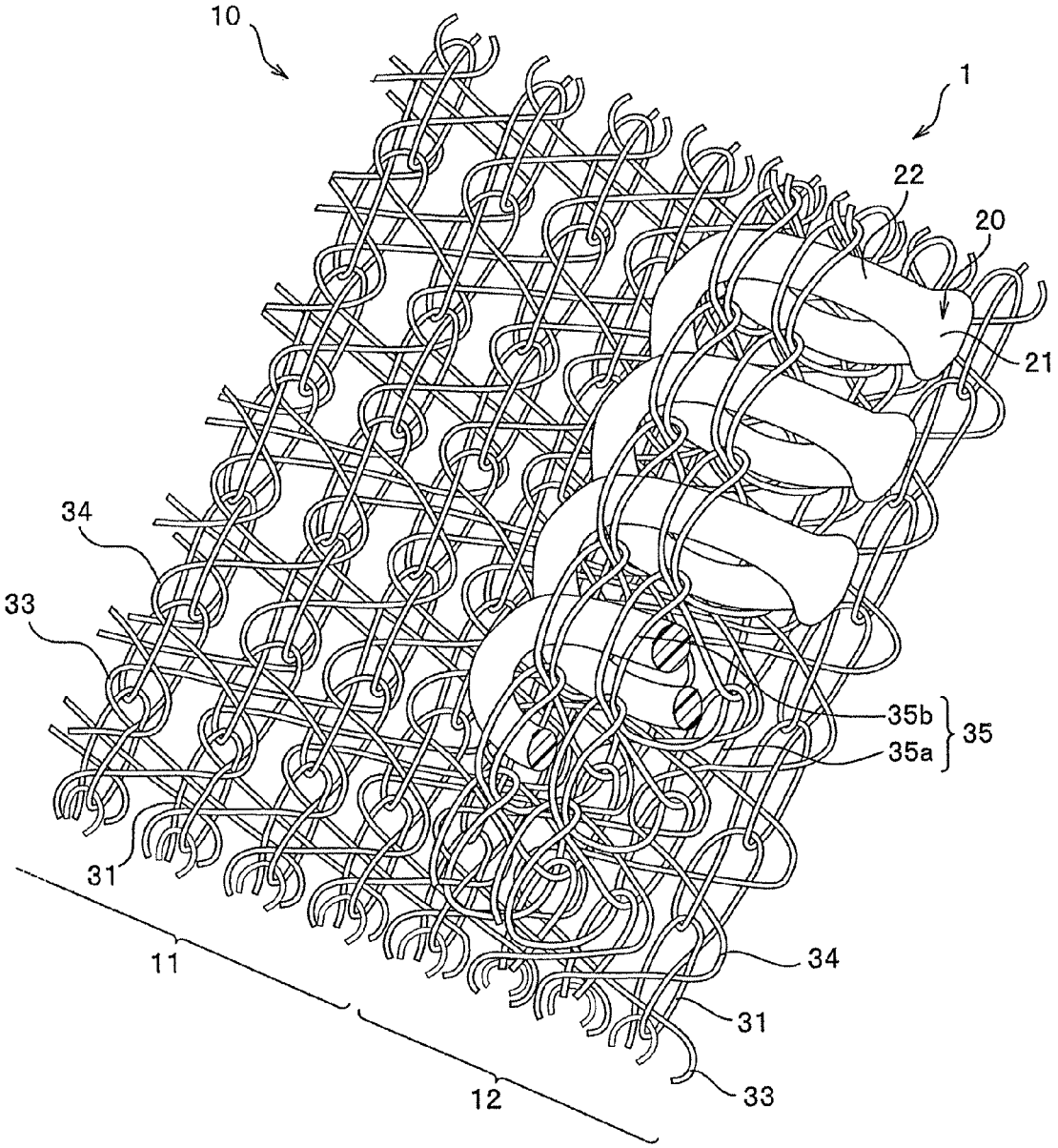
FIG. 3 is a partial perspective view schematically illustrating a knit structure of an element attaching portion in a knitted fastener stringer.

FIG. 1 is a structure diagram illustrating a knit structure of a fastener tape in embodiment 1, and FIG. 2 is a structure diagram illustrating each constituent yarn used for the fastener tape. FIG. 3 is a partial perspective view schematically illustrating a knit structure of an element attaching portion in a knitted fastener stringer of embodiment 1.

In FIG. 3, the knit structure is illustrated with knitted stitches loosened while an illustration of a two stitch yarn disposed in the fastener tape is omitted in order to show a feature of embodiment 1 in a manner easy to understand. Also, in the following description, a longitudinal direction of the fastener tape is defined as a course direction, and each wale which will be described later extends in the course direction. Further, a direction perpendicular to the longitudinal direction on a plane surface of the fastener tape is defined as a width direction of the fastener tape.

A knitted fastener stringer 1 of embodiment 1 comprises a fastener tape 10 comprising a tape main body portion 11 and an element attaching portion 12, and a continuous fastener element 20 knitted and fixed to the element attaching portion 12. In this case, the fastener element 20 is configured similarly to a general fastener element used for a conventional knitted fastener stringer 1, and size and an attaching pitch of the fastener element 20 is set similarly to the conventional one.

Thus, the fastener element 20 of embodiment 1 comprises a coupling head portion 21, upper and lower leg portions 22 extending in the tape width direction from the coupling head portion 21, and a connecting portion 23 (also called reversing portion) connecting the fastener elements 20 adjacent to each other, and is formed by for example winding a monofilament into a coil shape after the coupling head portion 21 is formed by pressing the monofilament made of a synthetic resin in a predetermined interval by stamping processing.

In this fastener element 20, the upper and lower leg portions 22 are knitted and fixed to the element attaching portion 12 at the same time as knitting the fastener tape 10 with the coupling head portion 21 protruding outward from a tape side edge on the element attaching portion 12 side of the fastener tape 10 (hereinafter this tape side edge will be referred to as a tape inner side edge, and a tape side edge on the opposite side will be referred to as a tape outer side edge).

In this case, the upper and lower leg portions 22 of the fastener element 20 are fastened and fixed in a tape front and rear direction by a fixing chain stitch yarn 35 which is knitted into second and third wales $W_2$, $W_3$ which will be described later while traveling in a weft direction in a same course and astride three rows of a first wale $W_1$ to the third wale $W_3$ constituting the element attaching portion 12.

The fastener tape 10 of embodiment 1 is knitted by using a double warp knitting machine having two rows of needle beds, and a whole tape width of the fastener tape 10 consists of n rows of the first wale $W_1$ to an n-th wale $W_n$. In this case, a wale in a first row which is disposed on the tape innermost side edge side in the fastener tape 10 is set as the first wale $W_1$, and a wale in an n row which is disposed on the tape outermost side edge side is set as the n-th wale $W_n$.

This fastener tape 10 comprises a tape main body portion 11 having a warp knit structure and the element attaching portion 12 which is knitted integrally along one side edge of the tape main body portion 11. In embodiment 1, as shown in FIG. 1, the element attaching portion 12 consists of the first wale $W_1$ to the third wale $W_3$, and is knitted in a double structure by using a back needle row B and a front needle row F.

The tape main body portion 11 consists of a fourth wale $W_4$ to the n-th wale $W_n$, and is knitted in a single structure by using the single back needle row B. In this case, in embodiment 1, the fastener tape 10 is knitted at a rate that one needle loop formed by the back needle row B in the tape main body portion 11 and the element attaching portion 12 (back side needle loop) and one needle loop formed by the front needle row F in the element attaching portion 12 (frond side needle loop) are formed in a tape length direction with respect to each one pitch of the fastener element 20.

Also, in the fastener tape 10 of embodiment 1, an ear portion 13 for stably maintaining a form of the fastener tape 10 is formed in an n-2-th wale $W_{n-2}$ to the n-th wale $W_n$ on the tape outer side edge side of the tape main body portion 11. Note that, in the invention, the number of wales constituting the element attaching portion 12, the tape main body portion 11, and the ear portion 13 can be arbitrary set or modified depending on a size of a slide fastener or the fastener element 20 and the like.

In embodiment 1, the knit structure of the tape main body portion 11 knitted by using the single back needle row B is configured by using a ground chain stitch yarn 31 (0-1/1-1/1-0/0-0) which is disposed in each wale, a two stitch yarn 32 (2-0/0-0/0-2/2-2), a first weft inserted yarn 33 (0-0/2-2/4-4/2-2) which is inserted astride three wales in a zigzag pattern, and a second weft inserted yarn 34 (2-2/1-1/0-0/1-1) which is inserted in a zigzag pattern in a direction intersecting the first inserted yarn 33 between courses while striding across two wales.

Since the ground chain stitch yarn 31 and the two stitch yarn 32 are disposed in the tape main body portion 11 as above, two needle loops are formed and entangled at each stitch, and the needle loops disposed in adjacent wales are securely connected to each other by a sinker loop of the two stitch yarn 32. As a result, the respective yarns 31-34 constituting the tape main body portion 11 can be prevented from moving in a warp direction or a weft direction, and the tape main body portion 11 can be formed in a secure knit structure whose stitch position is difficult to be displaced.

Furthermore, since the first and second weft inserted yarns 33, 34 are inserted into this tape main body portion 11, a form of the tape main body portion 11 can be more stabilized by effectively reinforcing the tape main body portion 11, while flexibility and texture of the fastener tape 10 are properly maintained. Here, an intersection of the first weft inserted yarn 33 and the second weft inserted yarn 34 between courses means that a direction in which the first weft inserted yarn 33 is folded back and a direction in which the second weft inserted yarn 34 is folded back are out of alignment in one course in a course direction.

An ear portion 13 in this tape main body portion 11 is formed by not using the second weft inserted yarn 34, but by using three kinds of yarns of the ground chain stitch yarn 31, the two stitch yarn 32, and the first weft inserted yarn 33 in order to increase flexibility of the knitted fastener stringer 1.

On the other hand, the knit structure of the element attaching portion 12 knitted in the double structure is formed by using the ground chain stitch yarn 31 which is knitted into the first wale $W_1$, the fixing chain stitch yarn 35 (1-0/0-1/1-0/0-1) which is knitted into the second and third wales $W_2$, $W_3$, and the two stitch yarn 32, the first weft inserted yarn 33, and the second weft inserted yarn 34 which are disposed continuously from the tape main body portion 11.

In this element attaching portion 12, the ground chain stitch yarn 31 and the two stitch yarn 32 are knitted while forming needle loops at a needle position of the back needle row B. Also, the fixing chain stitch yarn 35 is knitted while forming the first needle loop (back side needle loop) 35*a* which is knitted into the ground structure of the element attaching portion 12 at the needle position of the back needle row B and forming the second needle loop (front side needle loop) 35*b* which strides across and presses the upper and lower leg portions 22 of the fastener element 20 at a needle position of the front needle row F.

Figure 4:
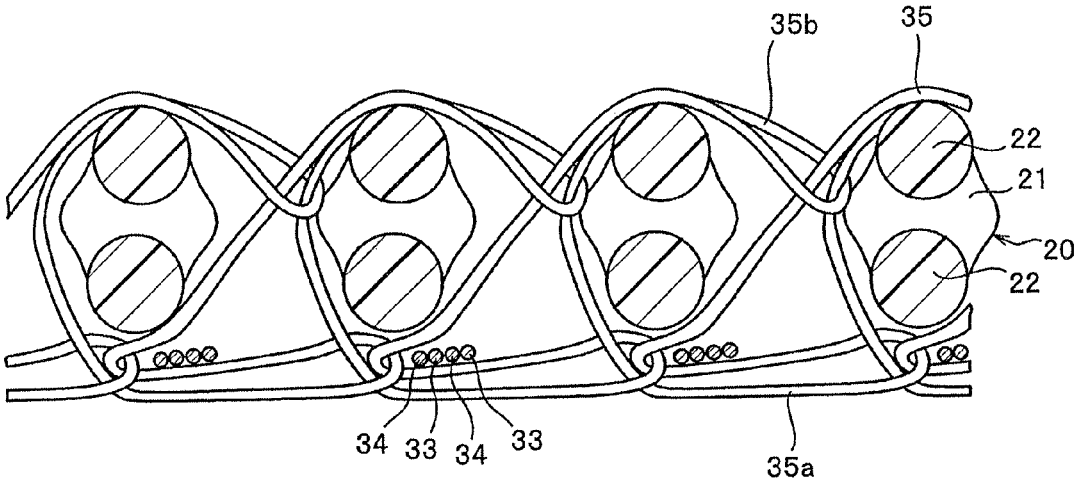
FIG. 4 is a cross-section view illustrating a relationship between a fixing chain stitch yarn and upper and lower leg portions of a fastener element in a knitted fastener stringer.

In this case, as shown in FIGS. 3 and 4, the fixing chain stitch yarn 35 is knitted while forming a stitch at a rate that one first and one second needle loops 35*a*, 35*b* are formed in each one pitch (a distance in the length direction between adjacent coupling head portions 21) of the fastener element 20.

Also, a pair of the upper and lower leg portions 22 of the fastener element 20 is inserted into a same course of the element attaching portion 12 with each formation of the second needle loop 35*b* in the fixing chain stitch yarn 35. As a result, since each second needle loop 35*b* is entangled with the second needle loop 35*b* which is subsequently formed while certainly striding across the pair of upper and lower leg portions 22, the upper and lower leg portions 22 of the fastener element 20 are stably fastened and fixed to the element attaching portion 12 by each second needle loop 35*b*.

Also, since the first needle loop 35*a* of the fixing chain stitch yarn 35 forms the ground structure of the element attaching portion 12 by being entangled with a needle loop of the ground chain stitch yarn 31 and the two stitch yarn 32, and further, the first and second weft inserted yarns 33, 34 are inserted into the ground structure of the element attaching portion 12, the element attaching portion 12 is firmly and strongly formed while the flexibility and the texture are properly maintained.

In the knitted fastener stringer 1 of embodiment 1, the knit structure and the form of the fastener tape 10 is fixed and maintained by performing a heat set after the fastener tape is knitted in the above-described knit structure.

As described above, in the knitted fastener stringer 1 of embodiment 1, although a length itself of one pitch of the fastener element 20 does not differ from a fastener element of a conventional general knitted fastener stringer and has approximately the same dimension, one back side needle loop which is formed in the back needle row B and one front side needle loop which is formed in the front needle row F are formed in the tape length direction with respect to the length of each one pitch of the fastener element 20, and the relative number of the stitches of the fastener tape 10 with respect to the pitch of the fastener element 20 (particularly, the relative number of the first and second needle loops 35*a*, 35*b* of the fixing chain stitch yarn 35 with respect to the pitch of the fastener element 20) decreases from the conventional one.

Namely, in embodiment 1, since the number of the stitches formed per unit length of the knitted fastener stringer 1 (the number of the first and second needle loops 35*a*, 35*b* of the fixing chain stitch yarn 35) largely decreases from the conventional one, it is possible to easily increase the knitting speed when knitting the knitted fastener stringer 1 and to achieve improvement of production efficiency and a large reduction of a manufacturing cost.

Particularly, in embodiment 1, by decreasing the number of the first and second needle loops 35*a*, 35*b* formed per unit length of the fixing chain stitch yarn 35, a movement of the upper and lower leg portions 22 can be allowed within a minute range while the upper and lower leg portions 22 of the fastener element 20 are properly fastened and fixed to the element attaching portion 12.

As a result, in the knitted fastener stringer 1 of embodiment 1, flexibility by which the element attaching portion 12 can be easily bent in the tape front and rear direction and the width direction and a soft texture can be stably obtained, while when forming the slide fastener, a proper coupling strength of an element row is ensured. This knitted fastener stringer 1 of embodiment 1 is particularly preferably applied to a small-size knitted fastener stringer in which the pitch of the fastener element 20 is set small and the like.

Note that the invention is not limited to the configuration of the above-described knitted fastener stringer 1 of embodiment 1 and the configurations of the knitted fastener stringers 2-4 of embodiments 2-4 which will be described later, but a type of the constituent yarn constituting the knitted fastener stringer and a form of the knitted fastener stringer and the like can be arbitrary modified depending on a function and a use required for a slide fastener.

For example, in a case of further increasing the flexibility of the knitted fastener stringer 1, the ground chain stitch yarn 31 which is disposed in the n-2-th wale $W_{n-2}$ to the n-th wale $W_n$ constituting the ear portion 13 or the ground chain stitch yarn 31 which is disposed in the n-th wale $W_n$ disposed on the tape outermost side edge side is formed by a water-soluble yarn.

After knitting the knitted fastener stringer 1, the ground chain stitch yarn 31 can be dissolved in a liquid by immersing the knitted fastener stringer 1 in the liquid (for example, water). As a result, the flexibility of the whole knitted fastener stringer 1 can be improved by further increasing a stretching property of the ear portion 13 of the fastener tape 10.

Figure 9:
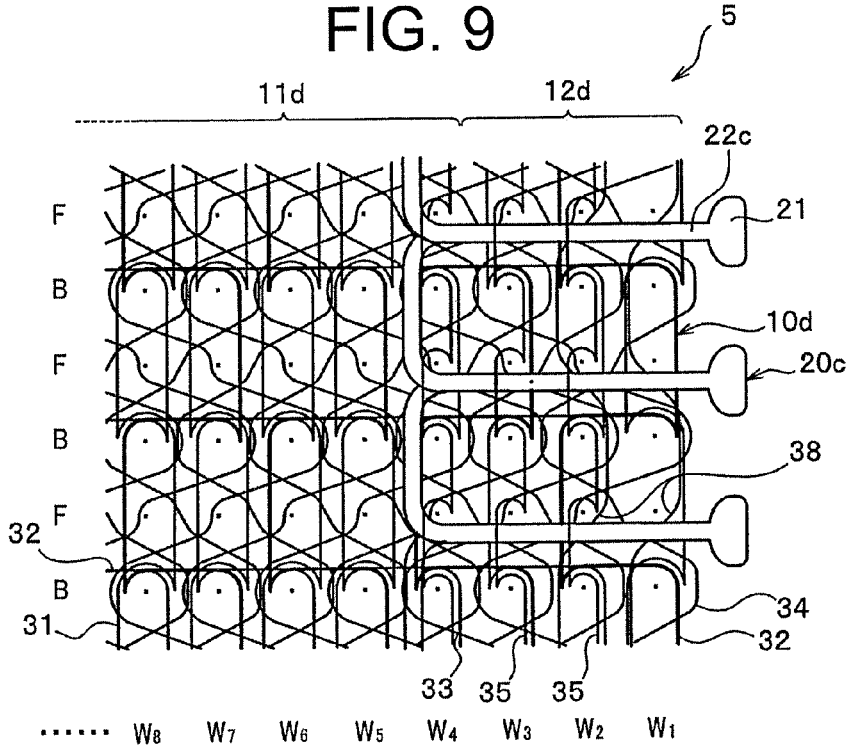
FIG. 9 is a structure diagram illustrating a knit structure of a fastener tape in a knitted fastener stringer according to a variant example of embodiment 4.
Figure 10:
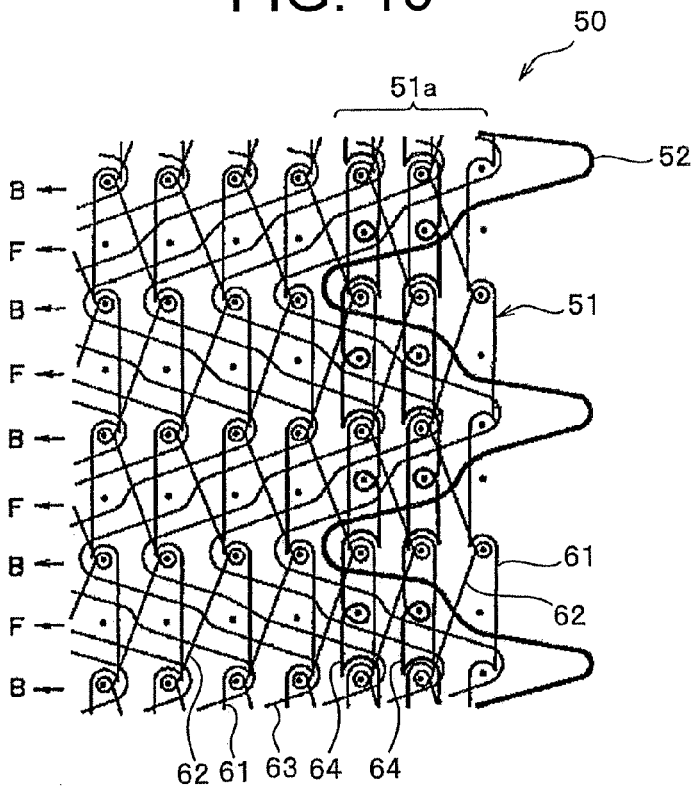
FIG. 10 is a structure diagram illustrating a knit structure of a fastener tape in a conventional knitted fastener stringer.
Figure 11:
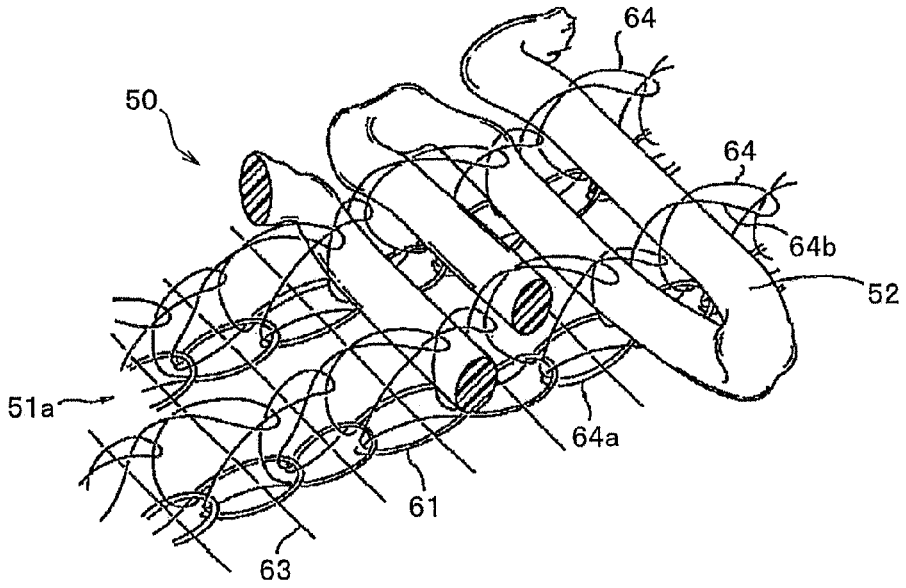
FIG. 11 is a partial perspective view schematically illustrating a knit structure of an element attaching portion in the knitted fastener stringer.
Figure 12:
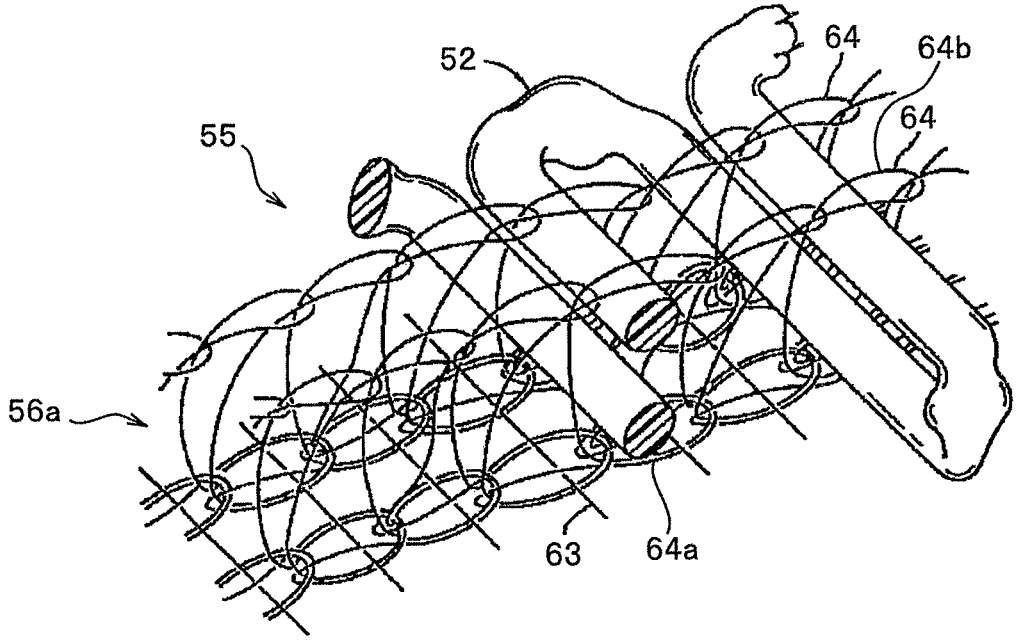
FIG. 12 is a partial perspective view schematically illustrating a knit structure of an element attaching portion in another conventional knitted fastener stringer.

Furthermore, for example when forming the slide fastener, it is possible to insert a warp inserted yarn 38 traveling in a zigzag pattern in the warp direction in at least one wale constituting the element attaching portion 12 (for example, the first and second wales $W_1$, $W_2$) in order to make a coupling breakage difficult to occur against a force in the tape front and rear direction (pushing up force) (see a variant example of embodiment 4 shown in FIG. 9).

Also, although the above-described knitted fastener stringer 1 of embodiment 1 is formed as a fastener stringer used for a general type of slide fastener, it may be formed as a knitted fastener stringer for a concealed slide fastener by for example changing an orientation of a coupling head portion of a fastener element which is fixed to an element attaching portion of a fastener tape.

For example, in case of producing the fastener stringer for the concealed slide fastener, when knitting the fastener tape 10, upper and lower leg portions of a fastener element are fastened and fixed by the fixing chain stitch yarn 35 in a position that the coupling head portion of the fastener element is oriented to the tape main body portion 11 side from a boundary portion between the element attaching portion 12 and the tape main body portion 11.

After knitting the knitted fastener stringer, the element attaching portion 12 of the fastener tape 10 is folded back to the tape main body portion 11 side along the above-mentioned boundary portion, and heat set treatment is performed in a state where the coupling head portion of the fastener element protrudes outward from an U-shaped folded back portion which is folded back as above. As a result, the knitted fastener stringer for the concealed slide fastener can be obtained.

Even in this knitted fastener stringer for the concealed slide fastener, effects similar to the above-described general type of knitted fastener stringer 1 in embodiment 1 can be obtained.

Embodiment 2

Figure 5:
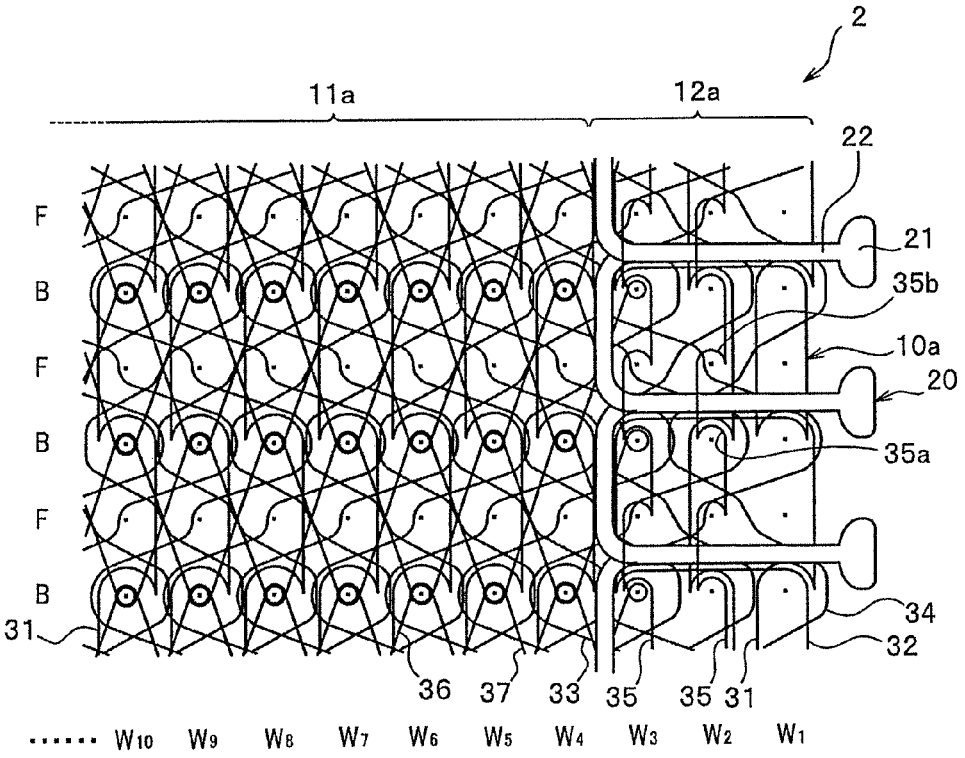
FIG. 5 is a structure diagram illustrating a knit structure of a fastener tape in a knitted fastener stringer according to embodiment 2 of the invention.
Figure 6:
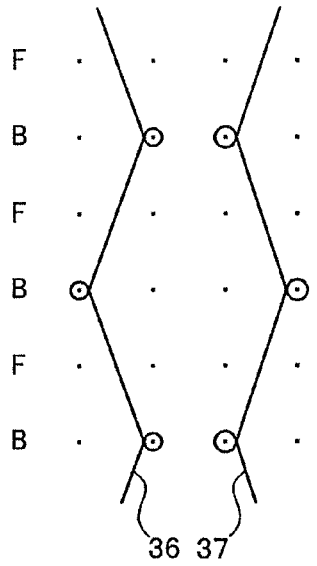
FIG. 6 is a structure diagram illustrating first and second tricot stitch yarns used for the fastener tape.

FIG. 5 is a structure diagram illustrating a knit structure of a fastener tape of a knitted fastener stringer according to embodiment 2, and FIG. 6 is a structure diagram of first and second tricot stitch yarns used for the fastener tape.

In a knitted fastener stringer 2 of embodiment 2, first and second tricot stitch yarns 36, 37 which will be described later are substituted for the above-mentioned two stitch yarn 32 which is disposed in the knitted fastener stringer 1 according to embodiment 1 in a knit structure of a tape main body portion 11*a*, and other configurations are substantially similar to that of the above-described knitted fastener stringer 1 according to embodiment 1. Therefore, in embodiment 2 and embodiments 3 and 4 which will be described later, an explanation for a configuration similar to that of the above-described knitted fastener stringer 1 of embodiment 1 will be omitted by expressing it by the same reference numerals.

A fastener tape 10*a* of embodiment 2 comprises the tape main body portion 11*a*, and an element attaching portion 12*a* which is knitted integrally along one side edge of the tape main body portion 11*a*. The element attaching portion 12*a* is configured by a first wale $W_1$ to a third wale $W_3$ and knitted in a knit structure substantially similar to that of the above-described knitted fastener stringer 1 according to embodiment 1 by using a back needle row B and a front needle row F.

The tape main body portion 11*a* is configured by a fourth wale $W_4$ to an n-th wale $W_n$ and knitted in a single structure by using a single back needle row B. Also, an ear portion (not shown) is formed from an n-2-th wale $W_{n-2}$ to an n-th wale $W_n$ in a tape outer side edge side of the tape main body portion 11*a*.

Also in embodiment 2, the fastener tape 10*a* is knitted at a rate that one needle loop formed by the back needle row B and one needle loop formed by the front needle row F are formed in a tape length direction with respect to each one pitch of a fastener element 20.

In this case, a knit structure of the tape main body portion 11*a* is configured by using a ground chain stitch yarn 31 which is disposed in each wale, a first tricot stitch yarn 36 (1-2/1-1/1-0/1-1) and a second tricot stitch yarn 37 (1-0/1-1/1-2/1-1) which are disposed on an area of the third wale $W_3$ to the n-th wale $W_n$, and first and second weft inserted yarns 33, 34. Since the ground chain stitch yarn 31 and the first and second tricot stitch yarns 36, 37 are disposed in the tape main body portion 11*a* as above, it is possible to stably form the knit structure of the tape main body portion 11*a* and to prevent a stitch position from being displaced.

Also in this knitted fastener stringer 2 of embodiment 2, like the above-described embodiment 1, the relative number of stitches formed in the back needle row B and the front needle row F with respect to the pitch of the fastener element 20 (particularly, the relative number of first and second needle loops 35*a*, 35*b* of a fixing chain stitch yarn 35) is small.

As a result, it is possible to easily increase a knitting speed when knitting the knitted fastener stringer 2 and to achieve an improvement of production efficiency and a large reduction of a manufacturing cost. Also, in the knitted fastener stringer 2 of embodiment 2, flexibility and a soft texture can be stably obtained, while a proper coupling strength of an element row when forming the slide fastener is ensured.

Embodiment 3

Figure 7:
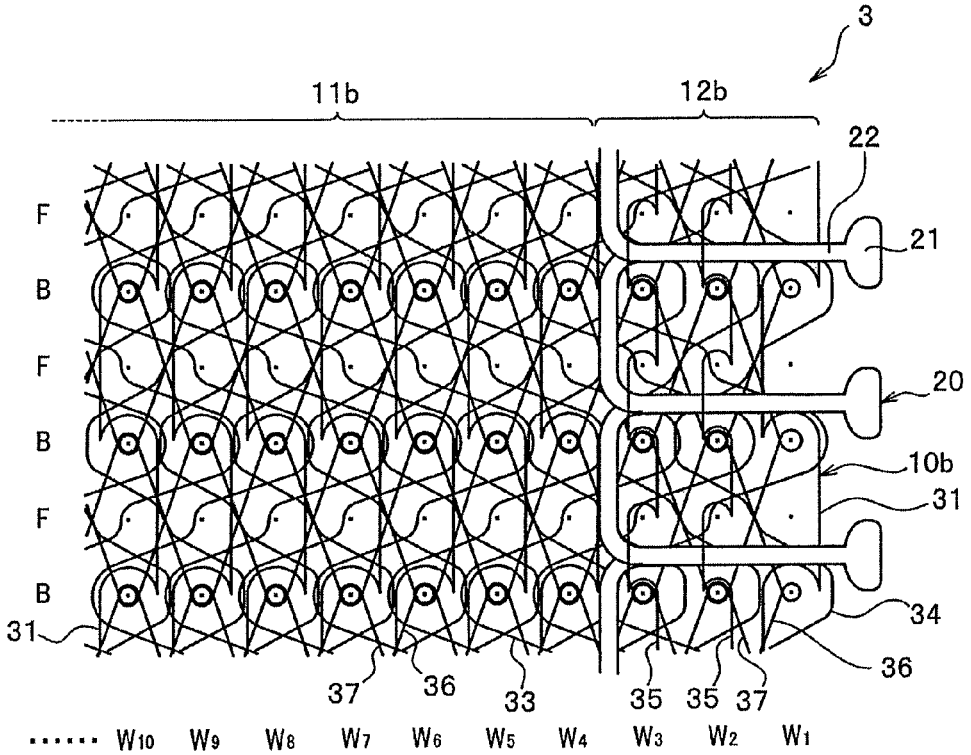
FIG. 7 is a structure diagram illustrating a knit structure of a fastener tape in a knitted fastener stringer according to embodiment 3 of the invention.

FIG. 7 is a structure diagram illustrating a knit structure of a fastener tape in a knitted fastener stringer according to embodiment 3.

A fastener tape 10*b* of embodiment 3 comprises a tape main body portion 11*b* (a fourth wale $W_4$ to an n-th wale $W_n$) knitted in a single structure by using a back needle row B and an element attaching portion 12*b* (a first wale $W_1$ to a third wale $W_3$) knitted in a double structure by using the back needle row B and a front needle row F, and an ear portion (not shown) is formed on a tape outer side edge side of the tape main body portion 11*b*.

Also in embodiment 3, the fastener tape 10*b* is knitted at a rate that one needle loop formed by the back needle row B and one needle loop formed by the front needle row F are formed in a tape length direction with respect to each one pitch of a fastener element 20.

A knit structure of the tape main body portion 11*b* is configured by using a ground chain stitch yarn 31, first and second tricot stitch yarns 36, 37, and first and second weft inserted yarns 33, 34 like the above-described embodiment 2. Also, a knit structure of the element attaching portion 12*b* is configured by using a ground chain stitch yarn 31 which is knitted into the first wale $W_1$, a fixing chain stitch yarn 35 which is knitted into second and third wales $W_2$, $W_3$, and a first tricot stitch yarn 36, a second tricot stitch yarn 37, a first weft inserted yarn 33, and a second weft inserted yarn 34 which are disposed continuously from the tape main body portion 11*b*.

In this knitted fastener stringer 3 of embodiment 3, like the above-described embodiments 1 and 2, since the relative number of stitches formed in the back needle row B and the front needle row F with respect to the pitch of the fastener element 20 is small, effects similar to that of the above-described embodiments 1 and 2 can be obtained.

Furthermore, in the knitted fastener stringer 3 of embodiment 3, since a knit structure of the tape main body portion

11*b* and the element attaching portion 12*b* is configured by not using the above-mentioned two stitch yarn 32 of embodiment 1, but by using the first and second tricot stitch yarns 36, 37, production efficiency can be further improved by increasing a knitting speed of the knitted fastener stringer 3 than that in a case of the above-described embodiment 1.

Embodiment 4

Figure 8:
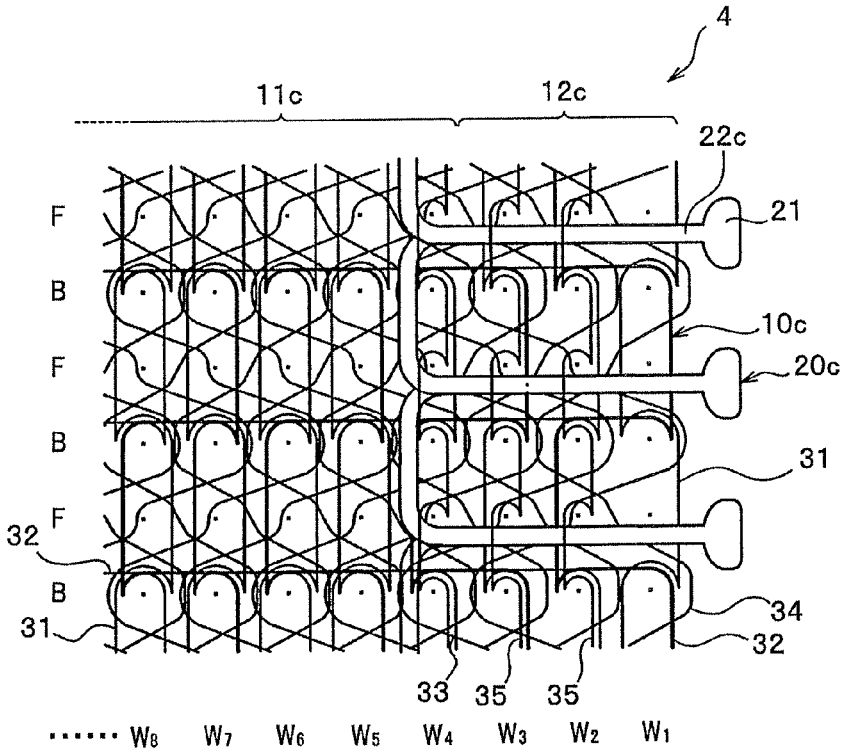
FIG. 8 is a structure diagram illustrating a knit structure of a fastener tape in a knitted fastener stringer according to embodiment 4 of the invention.

FIG. 8 is a structure diagram illustrating a knit structure of a fastener tape in a knitted fastener stringer according to embodiment 4.

In a fastener tape 10*c* of embodiment 4, an element attaching portion 12*c* is formed wider than that of the above-described embodiment 1 across a first wale $W_1$ to a fourth wale $W_4$, and a fastener element 20*c* whose upper and lower leg portions 22*c* are long in a tape width direction is fastened and fixed to the element attaching portion 12*c* by using a fixing chain stitch yarn 35. Also, a tape main body portion 11*c* is formed across a fifth wale $W_5$ to an n-th wale $W_n$.

In this case, a knit structure of the tape main body portion 11*c* and the element attaching portion 12*c* is substantially similar to that in a case of the above-mentioned knitted fastener stringer 1 according to embodiment 1. Namely, a knit structure of the tape main body portion 11*c* is configured by using a ground chain stitch yarn 31, a two stitch yarn 32, and first and second weft inserted yarns 33, 34. Also, a knit structure of the element attaching portion 12*c* is configured by using the ground chain stitch yarn 31 which is knitted into the first wale $W_1$, a fixing chain stitch yarn 35 which is knitted into a second wale $W_2$ to the fourth wale $W_4$, and the two stitch yarn 32, the first weft inserted yarn 33, and the second weft inserted yarn 34 which are disposed continuously from the tape main body portion 11*c*.

Even in this knitted fastener stringer 4 of embodiment 4 in which the element attaching portion 12*c* is formed wide, effects similar to that of the above-described embodiment 1 can be obtained.

In embodiment 4, as for example a structure diagram of a fastener tape 10*d* according to a variant example is shown in FIG. 9, a warp inserted yarn 38 (0-0/1-1/1-1/0-0) which travels in a zigzag pattern in a warp direction can be further inserted to a ground structure side (needle loop side formed in a back needle row B) of the first and second wales $W_1$, $W_2$ in the element attaching portion 12*d*.

By inserting the warp inserted yarn 38 in a predetermined wale constituting the element attaching portion 12*d* as above, the tape form can be more stabilized by reinforcing the ground structure of the element attaching portion 12*d* while flexibility of the element attaching portion 12*d* is ensured.

As a result, since a fixation of the fastener element 20 to the element attaching portion 12*d* can be more stabilized, when for example forming a slide fastener, even if a pushing up force in a tape front and rear direction (especially, pushing up force in the tape front and rear direction that pushes up from a tape rear surface side to a tape front surface side) is applied to the slide fastener in a closed state, it is possible to stably maintain a coupling state of an element row and to prevent a coupling breakage in the element row from occurring.

In this case, the number of insertions and a position of the insertion of the warp inserted yarn 38 can be arbitrary modified, and it is possible for example to insert the warp inserted yarn 38 into all wales constituting the element attaching portion 12*d* and also to insert the warp inserted yarn 38 into a part of or all wales constituting the tape main body portion 11*d*.

Furthermore, in a wale that the fixing chain stitch yarn 35 is knitted into, it is possible to insert the warp inserted yarn 38 to a needle loop side formed in the front needle row F while inserting the warp inserted yarn 38 to the needle loop side formed in the back needle row B as above. Also, it is possible to insert the warp inserted yarn 38 only to the needle loop side formed in the front needle row F while not inserting the warp inserted yarn 38 to the needle loop side formed in the back needle row B.

By inserting the warp inserted yarn 38 only to the needle loop side formed in the frond needle row F as above, when forming the slide fastener by using the knitted fastener stringer 5, even if the pushing up force from the tape front surface side toward the tape rear surface side is applied to the slide fastener in the closed state, the coupling breakage in the element row can be effectively prevented from occurring.

In the above-described embodiments 1-3, although the fastener element 20 is fixed by the fixing chain stitch yarn 35 which forms two rows of wales, in the invention, the fastener element may be fixed by knitting the fixing chain stitch yarn into three rows of wales.

DESCRIPTION OF REFERENCE NUMERALS

1 Knitted fastener stringer
2 Knitted fastener stringer
3 Knitted fastener stringer
4 Knitted fastener stringer
5 Knitted fastener stringer
10, 10*a* Fastener tape
10*b*, 10*c* Fastener tape
10*d* Fastener tape
11, 11*a* Tape main body portion
11*b*, 11*c* Tape main body portion
11*d* Tape main body portion
12, 12*a* Element attaching portion
12*b*, 12*c* Element attaching portion
12*d* Element attaching portion
13 Ear portion
20, 20*c* Fastener element
21 Coupling head portion
22, 22*c* Upper and lower leg portion
23 Connecting portion
31 Ground chain stitch yarn
32 Two stitch yarn
33 First weft inserted yarn
34 Second weft inserted yarn
35 Fixing chain stitch yarn
35*a* First needle loop (back side needle loop)
35*b* Second needle loop (front side needle loop)
36 First tricot stitch yarn
37 Second tricot stitch yarn
38 Warp inserted yarn
B Back needle row
F Front needle row

The invention claimed is:

1. A knitted fastener stringer comprising a fastener tape of a warp knit structure in which an element attaching portion is disposed along one side edge of a tape main body portion, and a continuous fastener element which is knitted and fixed to the element attaching portion, the element attaching portion being configured by at least a fixing chain stitch yarn which holds and fixes pairs of upper and lower leg portions of the fastener element in a tape front and rear direction, the fixing chain stitch yarn comprising a double structure with first needle loops which are knitted into a ground structure on a lower surface side of the pairs of the upper and lower leg portions of the element attaching portion and second needle loops which are disposed on an upper surface side of the upper and lower leg portions, and fasten and fix the upper and lower leg portions, wherein one of the first needle loops and one of the second needle loops of the fixing chain stitch yarn are formed at each one pitch of the fastener element, the first needle loops interlace with corresponding needle loops of ground knitting yarns and subsequent first needle loops, and each second needle loop fastens and fixes the upper and lower leg portions to the element attaching portion by striding across them while interlacing with subsequent second needle loops in series.

2. The knitted fastener stringer according to claim 1, wherein a first weft inserted yarn inserted astride two or more rows of wales, and a second weft inserted yarn inserted in a direction intersecting the first weft inserted yarn between courses while striding across two or more rows of wales are disposed in the ground structure of the tape main body portion and the element attaching portion.

3. The knitted fastener stringer according to claim 2, wherein the tape main body portion comprises an ear portion configured by two or more rows of wales on another side edge side of the tape main body portion, and wherein the second weft inserted yarn is absent from the ear portion.

4. The knitted fastener stringer according to claim 1, wherein a two stitch yarn or a tricot stitch yarn is knitted into the ground structure of the tape main body portion, and wherein the two stitch yarn or the tricot stitch yarn is knitted into the ground structure of the element attaching portion.

* * * * *